US009536653B2

(12) United States Patent
Yamada et al.

(10) Patent No.: US 9,536,653 B2
(45) Date of Patent: Jan. 3, 2017

(54) COIL COMPONENT, POWDER-COMPACTED INDUCTOR AND WINDING METHOD FOR COIL COMPONENT

(71) Applicant: Sumida Corporation, Chuo-ku, Tokyo (JP)

(72) Inventors: Satoru Yamada, Natori (JP); Yoshiyuki Hatayama, Natori (JP)

(73) Assignee: Sumida Corporation (JP)

( * ) Notice: Subject to any disclaimer, the term of this patent is extended or adjusted under 35 U.S.C. 154(b) by 64 days.

(21) Appl. No.: 14/324,585

(22) Filed: Jul. 7, 2014

(65) Prior Publication Data

US 2014/0320250 A1 Oct. 30, 2014

Related U.S. Application Data

(62) Division of application No. 13/449,976, filed on Apr. 18, 2012, now Pat. No. 8,864,060.

(30) Foreign Application Priority Data

Apr. 25, 2011 (JP) ..... 2011-097313

(51) Int. Cl.
*H01F 27/29* (2006.01)
*H01F 27/02* (2006.01)
(Continued)

(52) U.S. Cl.
CPC ..... *H01F 27/29* (2013.01); *H01F 27/2823* (2013.01); *H01F 41/064* (2016.01); *H01F 41/071* (2016.01); *H01F 2017/048* (2013.01)

(58) Field of Classification Search
CPC ..... H01F 5/04; H01F 27/292; H01F 41/10; H01F 27/29; H01F 27/027; H01F 41/0612; H01F 27/2823; H01F 41/071
(Continued)

(56) References Cited

U.S. PATENT DOCUMENTS 4,926,111 A * 5/1990 Lungu ..... H01F 5/00 323/355
6,460,244 B1 * 10/2002 Shafer ..... H01F 17/04 29/592.1
(Continued)

FOREIGN PATENT DOCUMENTS

CN 102034593 A * 4/2011
CN 102034593 A 4/2011
(Continued)

OTHER PUBLICATIONS

Japanese Office Action for Application No. 2011-097313 dated May 1, 2015 with English translation (5 pages).

*Primary Examiner* — Elvin G Enad
*Assistant Examiner* — Kazi Hossain
(74) *Attorney, Agent, or Firm* — Harness, Dickey & Pierce, P.L.C.

(57) ABSTRACT

A coil component includes an air-core winding wire portion wound by a wire with a plurality of wound layers by alignment winding, a spiral shaped wound portion in which the wire wound in a spiral shape from an inner edge of an end surface toward an outer edge thereof along the end surface while in contact with the end surface on one side in the axis direction of the winding wire portion, a first lead portion extended and extracted outward from a winding first end point of the spiral shaped wound portion, and a second lead portion extended and extracted outward from a winding second end point at the outer circumference of the winding wire portion.

8 Claims, 10 Drawing Sheets

(51) Int. Cl.
*H01F 27/24* (2006.01)
*H01F 17/04* (2006.01)
*H01F 27/28* (2006.01)

(58) Field of Classification Search
USPC ..... 336/192, 198, 184, 232, 83, 212, 221
See application file for complete search history.

(56) References Cited

U.S. PATENT DOCUMENTS 6,617,948 B2 * 9/2003 Kuroshima ..... H01F 17/043 29/602.1
7,339,451 B2 3/2008 Liu et al.
7,714,687 B2 5/2010 Marui et al.
7,786,834 B2 * 8/2010 Yagasaki ..... H01F 17/04 336/192
7,830,237 B1 * 11/2010 Chen ..... H01F 17/043 336/220
8,207,807 B2 6/2012 Kikuchi et al.
8,373,532 B2 2/2013 Kikuchi et al.
8,723,629 B1 * 5/2014 Liu ..... H01F 27/29 336/192
2002/0097124 A1 * 7/2002 Inoue ..... H01F 1/24 336/83
2003/0141952 A1 7/2003 Moro et al.
2003/0222749 A1 * 12/2003 Kung ..... H01F 27/292 336/192
2007/0052510 A1 * 3/2007 Saegusa ..... H01F 27/022 336/92
2007/0273465 A1 * 11/2007 Feng ..... H01F 27/2866 336/212
2008/0136286 A1 6/2008 Hiramatsu et al.
2008/0186121 A1 8/2008 Kawahata et al.
2008/0310051 A1 * 12/2008 Yan ..... H01F 17/045 360/123.01
2009/0051475 A1 * 2/2009 Hsueh ..... H01F 17/04 336/83
2009/0091412 A1 * 4/2009 Shin ..... H01F 1/26 336/83
2010/0253456 A1 * 10/2010 Yan ..... H01F 17/045 336/83
2010/0271162 A1 * 10/2010 Yan ..... H01F 17/04 336/98
2013/0027161 A1 * 1/2013 Urano ..... H01F 27/292 336/83

FOREIGN PATENT DOCUMENTS

CN 201984938 U * 9/2011
CN 201984938 U 9/2011
JP 62-023346 3/1987
JP 03-004045 1/1991
JP 05-115159 5/1993
JP 08-316082 11/1996
JP 09-035930 2/1997
JP 2003-168610 6/2003
JP 2003-229311 8/2003
JP 2005-191403 7/2005
WO WO-01-20755 A1 3/2001

* cited by examiner

COIL COMPONENT, POWDER-COMPACTED INDUCTOR AND WINDING METHOD FOR COIL COMPONENT

CROSS REFERENCES TO RELATED APPLICATION

This application is a Divisional of U.S. application Ser. No. 13/449,976 filed Apr. 18, 2012, which contains subject matter related to Japanese Patent Application JP2011-097313 filed in the Japanese Patent Office on Apr. 25, 2011, the entire contents of which are incorporated herein by reference.

BACKGROUND

The present invention relates to a coil component including a winding wire portion which is formed by winding a wire having electrical conductivity into a plurality of layers by alignment winding, to a powder-compacted inductor incorporating the coil component and to a winding method for the coil component.

In the past, it has been known that an inductor may be configured with a powder-compacted body formed by compression-molding metal magnetic powder in which an air-core coil is embedded (hereinafter, referred to as a "powder-compacted inductor"). For example, see Japanese Patent Publication Numbers JP 2003-229311 and JP 2003-168610 described below. While this powder-compacted inductor has a small size and a short stature, it also has excellent direct-current superimposing characteristics and low electric current resistance. As a result, this powder-compacted inductor has been utilized as an inductor for a power supply of mobile-type electronic equipment, such as a notebook personal computer for which miniaturization and flattening are highly desirable.

An air-core coil of a multi-layer winding used for such a powder-compacted inductor also requires miniaturization and height-shortening. As winding methods for such a multi-layer winding coil, an alignment winding method and an α winding method have been generally used.

Alignment winding is generally construed as a technique in which, while one end (an end from which winding starts) of a wire is fastened to an inner wall portion of one side of a winding frame of a winding machine, the other end of the wire is sequentially fed. Thus, the wire is wound such that the adjacent wires closely contact each other. After a first wound layer (an inner circumference wound layer) is formed by winding the wire from the inner wall portion of one side of the winding frame to the inner wall portion of the other side of the winding frame, a second wound layer is formed around an outer circumference portion of the first wound layer. Specifically, because the wire is wrapped around the outer circumference portion of the first wound layer by a mechanism that reverses the wire feed direction at the inner wall portion of the other side of the winding frame, the wire is wound from the inner wall portion of the other side of the winding frame to the inner wall portion of the one side of the winding frame at the outer circumference portion so that the second wound layer is formed. After the second wound layer is formed, a third wound layer is formed at the outer circumference portion of the second wound layer. Specifically, because the wire is wrapped around the outer circumference portion of the second wound layer by the mechanism that reverses the wire feed direction at the inner wall portion of the one side of the winding frame, the wire is wound from the inner wall portion of the one side of the winding frame to the inner wall portion of the other side of the winding frame at the outer circumference portion of the second wound layer so that the third wound layer is formed. Thereafter, according to procedures similar to those discussed above, respective wound layers up to a final wound layer (an outermost circumference wound layer) are formed.

On the other hand, α winding is generally construed as a technique in which, while making an intermediate portion of the wire touch a center portion of a winding shaft of a winding machine, the wire is wound while the two ends of the wire are fed. For example, see Japanese Patent Publication Number JP S62-23346 described below. After a first wound layer is formed by winding the wires from the center portion of the winding shaft toward each of the inner wall portions of one side of a winding frame and the other side of the winding frame, a second wound layer is formed. Specifically, because the wire is wrapped around an outer circumference portion of the first wound layer by a mechanism that respectively reverses the wire feed directions at the inner wall portions of the one side of the winding frame and the other side of the winding frame, the wires are wound and aligned from the inner wall portions of the one side of the winding frame and the other side of the winding frame toward the center portion of the winding shaft at the outer circumference portion of the first wound layer so that the second wound layer is formed. After the second wound layer is formed, a third wound layer is formed at the outer circumference portion of the second wound layer. Specifically, because the wire is wrapped around the outer circumference portion of the second wound layer by the mechanism that respectively reverses the feed directions of the wires at the center portion of the winding shaft, the wires are wound from the center portion of the winding shaft toward each of the inner wall portions of the one side of the winding frame and the other side of the winding frame at the outer circumference portion of the second wound layer so that the third wound layer is formed. Thereafter, according to procedures similar to those discussed above, respective wound layers up to a final wound layer are formed.

In case of a wire being wound by α winding, because both end portions of the wire are extended and extracted outwardly from the outer circumference portion of the coil, there is an advantage that handling becomes easy when connecting both ends of the wire to the respective terminals. However, in α winding, when reversing the feed directions of the wires at the center portion of the winding shaft, the alignment of the wires is easily disturbed. Thus, for a coil subjected to α winding, there is a tendency that the wire occupancy (the ratio of the sum of the cross-sectional areas of the respective wires occupying the cross-sectional area of the coil) becomes low.

On the other hand, in a coil subjected to alignment winding, one end (an end from which winding starts) of the wire fastened to the inner wall portion of one side of a winding frame when being wound is pulled out from the inner circumference side of the coil to the outer circumference side across the end surface of one side in the axis direction of the coil. Because there is a problem that the height of the coil may increase by as much as the diameter of this pulled-out wire, is difficult to improve the wire occupancy for the coil.

SUMMARY

The present invention was invented in view of the problems discussed above. Exemplary objects of the present invention are to provide a coil component in which further miniaturization and height-shortening become possible by devising a pulling-out method when pulling out one end of a wire fastened to one end portion of a winding shaft toward the outer circumference when winding, to provide a powder-compacted inductor using this coil component, and to provide a winding method of this coil component.

A coil component according to the present application includes a winding wire portion in which a wire having electrical conductivity is wound into a plurality of wound layers, a spiral shaped wound portion in which the wire extends from a winding start point at an inner circumference of the winding wire portion and in which the wire is wound in a spiral shape from an inner edge of an end surface toward an outer edge of the end surface along the end surface while the wire is in contact with the end surface, the end surface being located at one side of the winding wire portion in a longitudinal axis direction of the winding wire portion, a first lead portion extending outwardly from a winding first end point of the spiral shaped wound portion, and a second lead portion extending outwardly from a winding second end point at an outer circumference of the winding wire portion.

It is possible for the coil component according to the present application to employ a configuration in which the winding start point at the inner circumference and the winding second end point at the outer circumference of the winding wire portion are both positioned at the one side of the winding wire portion, and the first and second lead portions both extend outwardly at the one side of the winding wire portion.

Also, a powder-compacted inductor according to the present application includes a powder-compacted body including compression-molded metal magnetic powder and the coil component that has the configuration discussed above. The coil component is embedded in the powder-compacted body.

Also, a winding method for the coil component that has the configuration discussed above includes providing a winding wire portion by fastening a portion of a wire that is continuous to a storage wire to an inner wall portion of one side of a winding frame, sequentially feeding another end of the wire, and forming a plurality of wound layers by alignment winding in which adjacent wound wires closely contact each other. The method further includes providing a spiral shaped wound portion after the winding wire portion is provided by feeding the storage wire and closely attaching the fed storage wire to an end surface so that the wire extends from a winding start point at an inner circumference of the winding wire portion and in which the wire is wound in a spiral shape from an inner edge of the end surface toward an outer edge of the end surface along the end surface while the wire is in contact with the end surface, the end surface being located at one side of the winding wire portion in a longitudinal axis direction of the winding wire portion. The method further includes extending a first lead portion outwardly from a winding first end point of the spiral shaped wound portion, and extending a second lead portion outwardly from a winding second end point at an outer circumference of the winding wire portion.

A coil component according to the present application includes a spiral shaped wound portion in which a wire extends from a winding start point at an inner circumference of a winding wire portion and in which the wire is wound in a spiral shape from an inner edge of an end surface, which is located at one side of the winding wire portion in an axis direction of the winding wire portion, toward an outer edge of the end surface along the end surface. Thus, because this spiral shaped wound portion can be used as a part of the winding wire portion, it is possible to achieve miniaturization and height-shortening compared with conventional coil components.

A powder-compacted inductor according to the present application includes the coil component discussed above in which miniaturization and height-shortening can be achieved, as a coil embedded inside a powder-compacted body. Therefore, because the powder-compacted body can be manufactured in a miniaturized and height-shortened form, miniaturization and height-shortening for the powder-compacted inductor can be achieved as a whole.

Also, in a winding method for a coil component according to the present application, it becomes possible to manufacture the coil component discussed above in which miniaturization and height-shortening can be achieved.

BRIEF DESCRIPTION OF THE DRAWINGS

FIG. 1A is a plan view. FIG. 1B is a front view. FIG. 1C is a right side view. FIG. 1D is a perspective view.

FIG. 3A is a plan view. FIG. 3B is a front view. FIG. 3C is a right side view.

FIG. 4A shows a conventional coil component. FIG. 4B shows a coil component according to a second embodiment of the present invention.

FIG. 5A shows a coil component according to a second embodiment of the present invention. FIG. 5B shows a conventional coil component.

FIGS. 6A-6D show first through fourth processes, respectively.

FIGS. 11A-11C show first through third processes, respectively.

FIG. 12A is a plan view. FIG. 12B is a front view.

DESCRIPTION OF THE PREFERRED EMBODIMENTS

Embodiments of a coil component and a powder-compacted inductor according to the present invention are explained below in detail with reference to the drawings.

Configuration of Coil Component

Figure 1A:
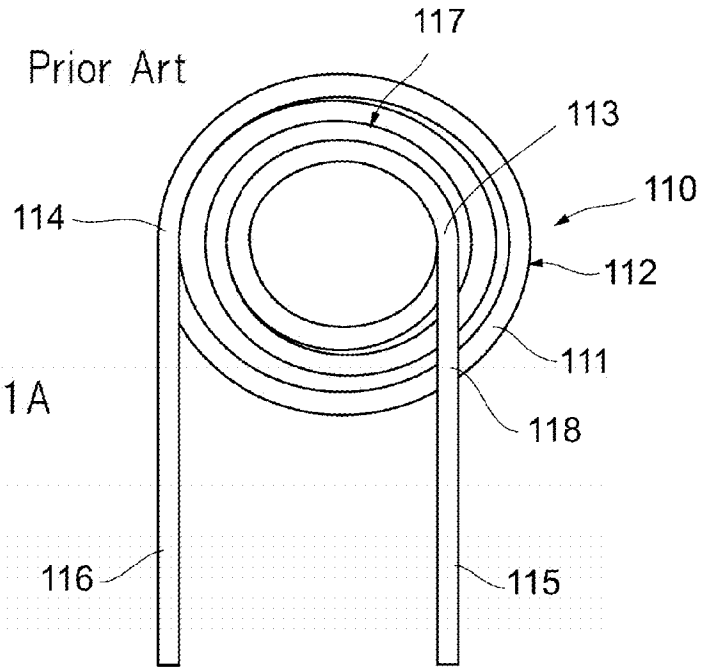
FIGS. 1A-1D are schematic views showing a conventional coil component.
Figure 1B:
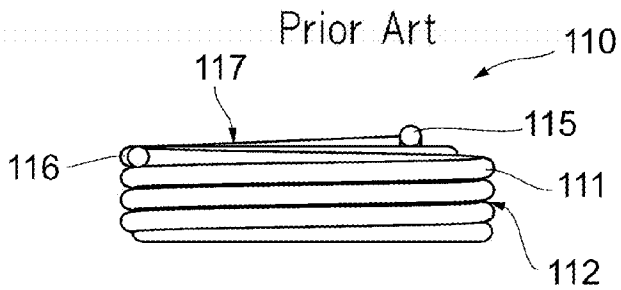
Figure 1C:
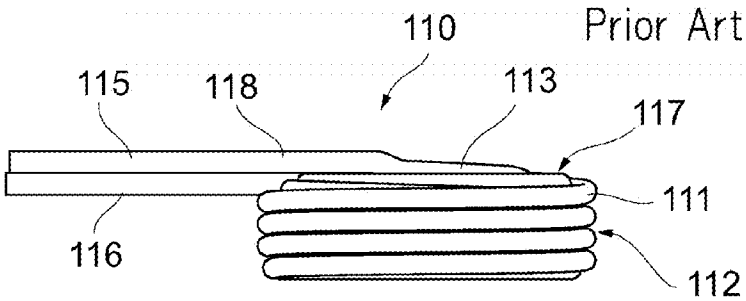
Figure 1D:
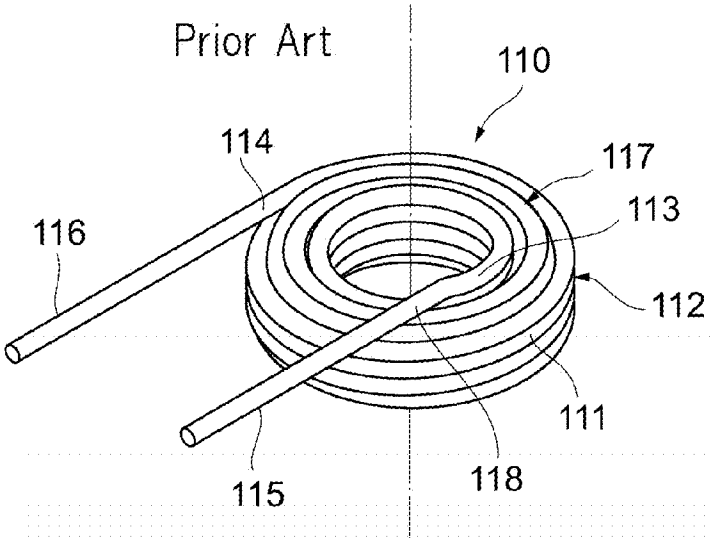

First of all, a configuration of a coil component 10 according to a first embodiment of the present invention will be explained with reference to FIGS. 2 and 3A-3C. However, to facilitate a characterized configuration of this coil component 10, a configuration of a conventional coil will be firstly explained with respect to the coil component 110 by using FIGS. 1A to 1D. It should be noted that in FIG. 2 and FIG. 1D an axis direction (axial line) is shown by a dashed line.

The coil component 110 shown in FIGS. 1A to 1D is for illustrating an air-core coil which is subjected to alignment winding and which has a conventional configuration. The coil component 110 is formed by being provided with an air-core winding wire portion 112 formed by a configuration in which a wire 111 having electrical conductivity is wound into a plurality of layers by alignment winding, a first lead portion 115 which is extended and extracted outward of the winding wire portion 112 from a winding start point 113 at the inner circumference of the winding wire portion 112 by way of an end surface 117 of one side in the axis direction of the winding wire portion 112 and which is constituted by a portion of one end of the wire 111, and a second lead portion 116 which is extended and extracted outward of the winding wire portion 112 from a winding end point 114 at the outer circumference of the winding wire portion 112 and which is constituted by a portion of the other end of the wire 111.

In this conventional coil component 110, the portion of the first lead portion 115 passing along the end surface 117 (portion of the first lead portion 115 overlapping the end surface 117, which will be referred to as "pull-out portion 118" hereinafter) is constituted so as to radially cross over the end surface 117.

In contrast, the coil component 10 according to the first embodiment of the present invention shown in FIG. 2 and FIGS. 3A to 3C is formed by being provided with an air-core winding wire portion 12 formed by a configuration in which a wire 11 having electrical conductivity is wound into a plurality of layers (four layers in the example shown in FIG. 2, and FIGS. 3A to 3C) by alignment winding, a spiral shaped wound portion 18 formed by extending from a winding start point 13 at the inner circumference of the winding wire portion 12 and by being wound in a spiral shape from the inner edge of an end surface 17 toward the outer edge thereof along the end surface 17 (see FIG. 3C) on one side in the longitudinal axis direction of the winding wire portion 12, a first lead portion 15 extended and extracted from a winding end point 19 of this spiral shaped wound portion 18 outward of the winding wire portion 12, and a second lead portion 16 extended and extracted from a winding end point 14 at the outer circumference of the winding wire portion 12 outward of the winding wire portion 12. It should be noted that the wire 11 is configured by a conductive wire having a surface that is covered by an insulative coating. However, it is also acceptable if a self-bonding wire is used that has an insulative coating layer and an adhesive layer.

The coil component 10 according to this first embodiment is constituted as the spiral shaped wound portion 18 which is formed by being wound in a spiral shape from the inner edge of an end surface 17 toward the outer edge thereof along the end surface 17 while a portion connecting the winding start point 13 at the inner circumference of the winding wire portion 12 and the first lead portion 15 is contacting the end surface 17. This aspect is different from that of the conventional coil component 110 shown in FIGS. 1A to 1D. Also, it is constituted such that the winding start point 13 at the inner circumference and the winding end point 14 at the outer circumference of the winding wire 12 are both positioned on one side in the axis direction of the winding wire portion 12. The first lead portion 15 and the second lead portion 16 are both extended and extracted outward of the winding wire portion 12 on the one side in the axis direction of the winding wire portion 12. It should be noted that the term "end surface 17" indicates an area exposed to one side in the axis direction of the winding wire portion 12 in case of removing the spiral shaped wound portion 18 from the coil component 10.

Effect of Coil Component

Next, an effect of a coil component according to the present invention will be explained below in detail with reference to FIGS. 4A-4B and 5A-5B. In FIGS. 4A-4B and 5A-5B, a coil component 10A according to a second embodiment of the present invention and another conventional coil component 110A are shown in comparison. In FIGS. 4A-4B and 5A-5B, vertical cross-sections of the coil components 10A, 110A are schematically shown. However, in FIGS. 4A and 4B, to roughly comprehend the winding orders of the wires 11A, 111A, reference numerals $W_1$ to $W_{16}$ (wire wound numbers) are added inside the cross-sections of the wires 11A, 111A. The winding states of wound layers at the inner circumferences are concurrently indicated by using broken lines and solid lines. Note that $W_1$ is the wire to be wound first; and $W_{16}$ is the wire to be wound last in this embodiment. Note also that the solid lines correspond to the wires at the near side; and the broken lines correspond to the wires at the far side.

Figure 4B:
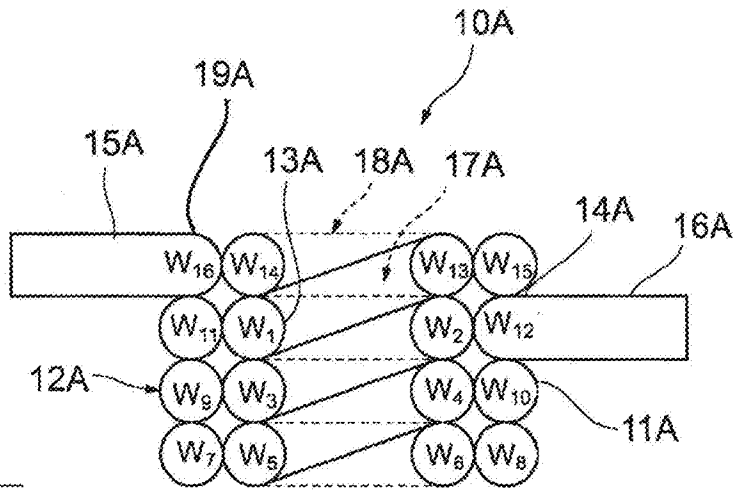
FIGS. 4A and 4B are diagrams for explaining an effect of miniaturization and height-shortening of a coil component.
Figure 4A:
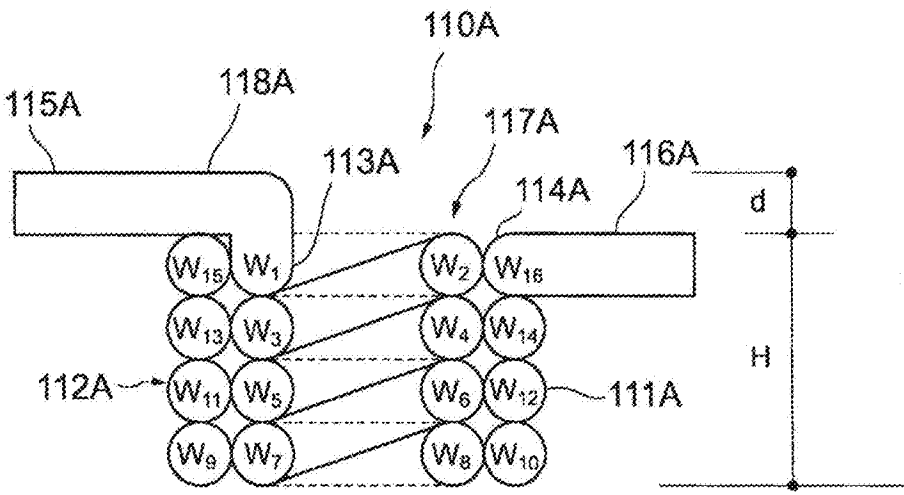
Fig. 4A Prior Art
Figure 5B:
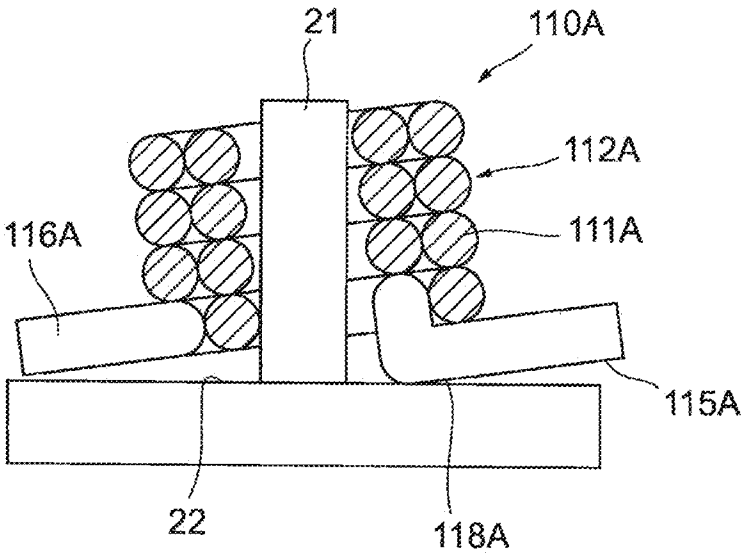
Fig. 5B Prior Art
FIGS. 5A and 5B are diagrams for explaining an effect of installation stability of a coil component.

The conventional coil component 110A shown in FIGS. 4A and 5B is identical to the conventional coil component 110 mentioned above in terms of basic configuration except an aspect that the number of wound layers in the winding wire portion 112A is two and the number of winding levels (number of laminated layers of the wire 111A in height direction) is four (hereinafter, such a state will be expressed such as the "winding configuration of two layers and four levels", simplifying the number of wound layers and the number of winding levels).

More specifically, as shown in FIG. 4A, with respect to the coil component 110A, an inner wound layer at the inner circumference (first wound layer) is formed by the wire 111A being wound in the order of $W_1 \rightarrow W_2 \rightarrow W_3 \rightarrow W_4 \rightarrow W_5 \rightarrow W_6 \rightarrow W_7 \rightarrow W_8$. Then, an outer wound layer at the outer circumference (second wound layer) is formed by the wire 111A being wound in the order of $W_9 \rightarrow W_{10} \rightarrow W_{11} \rightarrow W_{12} \rightarrow W_{13} \rightarrow W_{14} \rightarrow W_{15} \rightarrow W_{16}$, thereby forming an air-core winding wire portion 112A. Also, the coil component 110A includes a first lead portion 115A which is extended and extracted outward of the winding wire portion 112A from a winding start point 113A (cross-sectional position of the wire wound number $W_1$) at the inner circumference of the winding wire portion 112A by way of an end surface 117A (constituted by the exposed upper surface of wire 111A of the wire wound numbers $W_1$, $W_2$, $W_{15}$, $W_{16}$) on one side in the axis direction of the winding wire portion 112A. The coil component 110A includes a second lead portion 116A which is extended and extracted outward of the winding wire portion 112A from a winding end point 114A (cross-sectional position of the wire wound number $W_{16}$) at the outer circumference of the winding wire portion 112A. Thus, a portion (pull-out portion 118A) of the first lead portion 115A, which passes through the end surface 117A, is formed so as to radially cross over the end surface 117A.

Figure 5A:
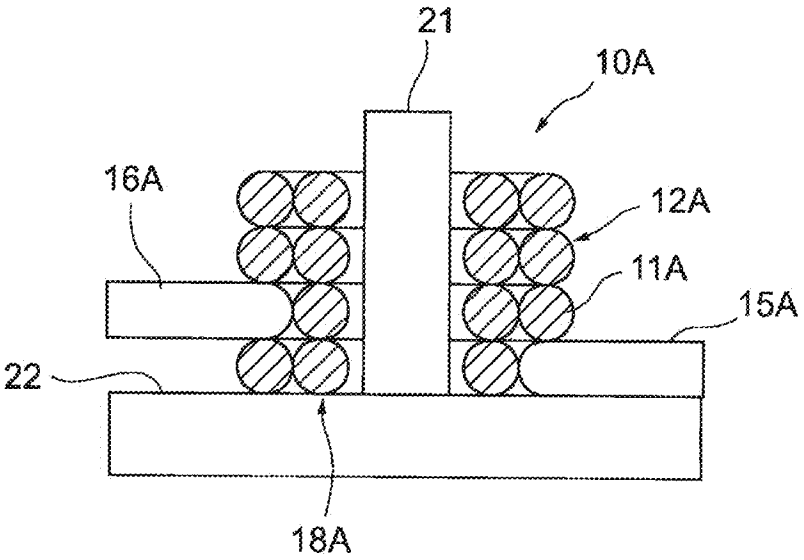

On the other hand, as shown in FIG. 4B and FIG. 5A, a coil component 10A according to a second embodiment of the present invention is identical to the coil component 10 according to the first embodiment mentioned above in terms of basic configuration, except an aspect in which a winding wire portion 12A has a winding configuration of two layers and three levels.

More specifically, as shown in FIG. 4B, with respect to the coil component 10A, an inner wound layer at the inner circumference (first wound layer) is formed by a wire 11A being wound in the order of $W_1 \rightarrow W_2 \rightarrow W_3 \rightarrow W_4 \rightarrow W_5 \rightarrow W_6$. Then, an outer wound layer at the outer circumference (second wound layer) is formed by the wire 11A being wound in the order of $W_7 \rightarrow W_8 \rightarrow W_9 \rightarrow W_{10} \rightarrow W_{11} \rightarrow W_{12}$, thereby forming an air-core winding wire portion 12A. Also, the coil component 10A includes a spiral shaped wound portion 18A which extends from a winding start point 13A (cross-sectional position of the wire wound number $W_1$) at the inner circumference of the winding wire portion 12A and which is formed by being wound in a spiral shape from an inner edge of an end surface 17A toward an outer edge thereof along the end surface 17A while being in contact with the end surface 17A (constituted by exposed upper surface of the wire 11A of the wire wound numbers $W_1$, $W_2$, $W_{11}$, $W_{12}$) on one side in the axis direction of the winding wire portion 12A. The coil component 10A also includes a first lead portion 15A which is extended and extracted outward of the winding wire portion 12A from a winding end point 19A of this spiral shaped wound portion 18A, and a second lead portion 16A which is extended and extracted outward of the winding wire portion 12A from the winding end point 14A (cross-sectional position of the wire number $W_{12}$) at the outer circumference of the winding wire portion 12A.

Because the spiral shaped wound portion 18A is constituted by the wire 11A being wound along the end surface 17A while in contact with the end surface 17A, the spiral shaped wound portion 18A functions as a part of the winding wire portion 12A. Consequently, in the coil component 10A, miniaturization and height-shortening are achieved although the number of windings as a whole is identical with respect to the conventional coil component 110A.

More specifically, as shown in FIG. 4A, in the conventional coil component 110A, the pull-out portion 118A is constituted so as to radially cross over the end surface 117A, so that the height of the coil component 110A becomes (H+d) in which the dimension equivalent to the diameter d of the wire 111A is added to the height H of the winding wire portion 112A. On the other hand, in the coil component 10A according to the second embodiment, the spiral shaped wound portion 18A functions as a part of the winding wire portion 12A, so that miniaturization and height-shortening are achieved by as much as the dimension of the diameter d of the wire 11A (same also for wire 111A) as compared with that of the conventional coil component 110A.

Also, in the conventional coil component 110A, the pull-out portion 118A is constituted so as to radially cross over the end surface 117A, so that only the pull-out portion 118A is one wrap higher than the position of the end surface 117A. On the other hand, in the coil component 10A according to the second embodiment, the spiral shaped wound portion 18A is constituted by being wound around in the spiral shape from the inner edge of the end surface 17A toward the outer edge thereof along the end surface 17A while in contact with the end surface 17A. Therefore, the spiral shaped wound portion 18A constitutes one end surface as a whole.

Thus, when it is assumed that the coil component 10A is used as one of a plurality of coil components (tracking coil for optical pickup) wound continuously as shown, for example, in Japanese patent publication Number JP H09-35930, a projection 21 is used for assembling the coil component 10A as shown in FIG. 5A. When the coil component 10A is mounted on a mounting surface 22 with the projection 21, it becomes possible to stably mount the coil component 10A while keeping it in a horizontal state even if the side of the spiral shaped wound portion 18A is made to face the mounting surface 22.

On the other hand, as shown in FIG. 5B, when the conventional coil component 110A is mounted on the mounting surface 22 such that the side of the pull-out portion 118A faces the mounting surface 22, the pull-out portion 118A becomes an obstacle. As a result, the coil component 110A is inclined with respect to the mounting surface 22 and stable mounting thereof becomes difficult. Then, to mount the coil component 110A stably, it is also conceivable that the side of the pull-out portion 118A faces upward in the drawing when the coil component 110A is mounted. However, in this case, because the first lead portion 115A and the second lead portion 116A will be spaced apart from the mounting surface 22, the wiring becomes aerial wiring when wiring the first lead portion 115A and the second lead portion 116A. When the wire 111A is particularly fine and narrow, there is a risk that the wire 111A will be easily broken.

In contrast, in the coil component 10A as shown in FIG. 5A, similarly to the coil component 10 of the first embodiment mentioned above, both the first lead portion 15A and the second lead portion 16A are extended and extracted outward of the winding wire portion 12A on one side in the axis direction of the winding wire portion 12A (lower side in FIG. 5A). Even if the side of the pull-out portion 18A is mounted so as to face the mounting surface 22, it becomes possible to wire the first lead portion 15A and the second lead portion 16A along the mounting surface 22. Therefore, it becomes possible to reduce the possibility of breaking the wire 11A.

Figure 2:
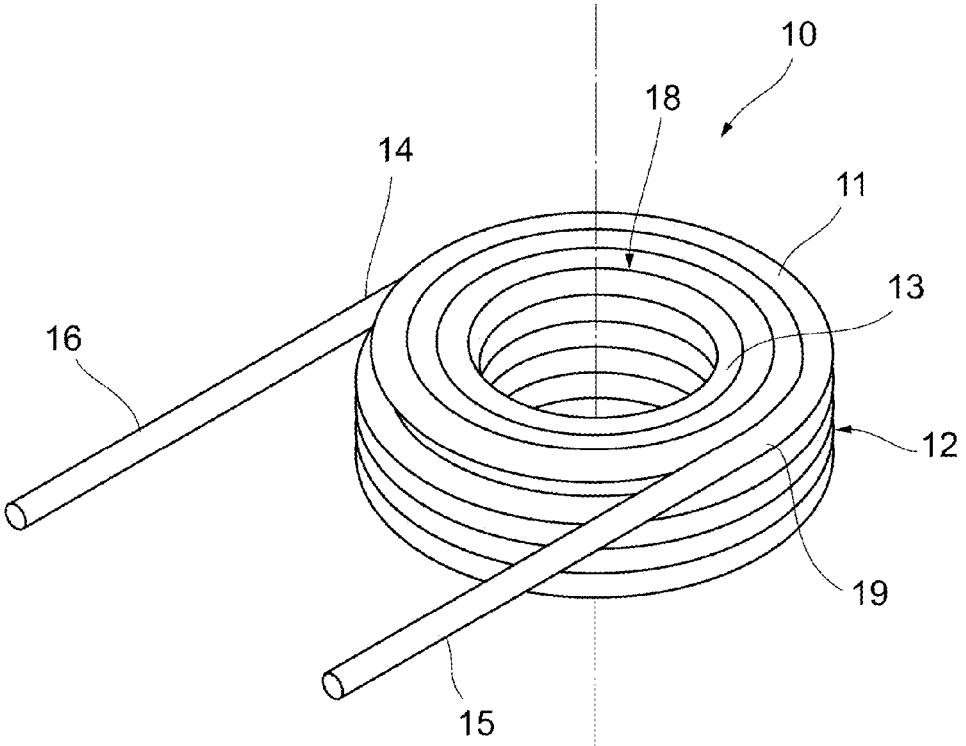
FIG. 2 is a perspective view showing an entire configuration of a coil component according to a first embodiment of the present invention.

It should be noted in the coil component 10A shown in FIG. 4B that, for example, each wire 11A corresponding to cross-sections $W_1$, $W_3$, $W_5$ which are positioned on the inner circumference side of the winding wire portion 12A respectively contacts each wire 11A of cross-sections $W_{11}$, $W_9$, $W_7$ which are positioned on the outer circumference side in a radial direction. Specifically, the wire wound number $W_7$ only contacts the wire wound number $W_5$, the wire wound number $W_9$ only contacts the wire wound number $W_3$, and the wire wound number $W_{11}$ only contacts the wire wound number $W_1$. However, there is also a case in which the wire 11A is wound around in such a way that the wire wound number $W_7$ contacts the respective wire wound numbers $W_3$, $W_5$ and the wire wound number $W_9$ contacts the respective wire wound numbers $W_3$, $W_1$, in a so-called trefoil formation state (such a winding state is shown in FIG. 2). In this specification, mainly a case of being wound around by the former aspect is illustrated and explained, however it is also possible to substitute the latter, in other words, the winding-around aspect in the trefoil formation state does not depart from the spirit and scope of the present invention.

Winding Method of Coil Component

Next, a winding method of the coil component according to the present invention will be explained in detail below with reference to FIGS. 6A to 6D. It should be noted in the following explanation that the coil component 10A according to the second embodiment mentioned above is used as an example, however it is possible to use the same winding method for coil components of other embodiments. Also, the wire wound numbers $W_1$ to $W_{16}$ indicated in FIGS. 6A to 6D correspond to the wire wound numbers $W_1$ to $W_{16}$ applied for the cross-section of the wire 11A for the coil component 10A shown in FIG. 4B.

(1) As a preparation stage, a cylindrical winding shaft 31 is disposed on a winding machine which is not shown. On the winding shaft 31, there are a first winding frame 32 and a second winding frame 33. The first winding frame 32 is constituted in a movable manner in a longitudinal axis direction of the winding shaft 31 (upward and downward directions in the drawing) (see FIG. 6A).

(2) By moving the first winding frame 32, a distance between the first winding frame 32 and the second winding frame 33 is adjusted. In this embodiment, the distance between the first winding frame 32 and the second winding frame 33 is adjusted so as to become a length which is approximately four times the diameter of the wire 11A.

Figure 6A:
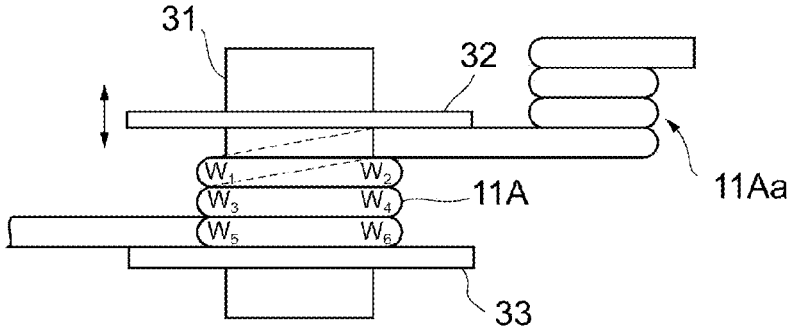
FIGS. 6A to 6D are diagrams for explaining a winding method for a coil component according to the present invention.

(3) As shown in FIG. 6A, on one end of the wire 11A, a storage wire 11Aa configured with the wire 11A having a predetermined length (length necessary for constituting the spiral shaped wound portion 18A and the first lead portion 15A shown in FIG. 4B) is secured in a storage member which is not shown. Then, while a portion continuous to the storage wire 11Aa on the one end of the wire 11A is fastened to an inner wall portion of the first winding frame 32, another end of the wire 11A is fed sequentially. Thus, the adjacent wound wires 11A closely contact each other by alignment winding. As a result, the first wound layer of the winding wire portion 12A (see FIG. 4B) is wound around in the order of the wire wound numbers $W_1 \rightarrow W_2 \rightarrow W_3 \rightarrow W_4 \rightarrow W_5 \rightarrow W_6$. Also, it is constituted such that a gap having a predetermined distance (for example, it is possible to set the distance to be the length equivalent to the diameter of wire 11A and it is also possible to widen the distance more than the diameter) is formed between the position of the wire wound numbers $W_1$, $W_2$ of the wire 11A and the first winding frame 32.

Figure 6B:
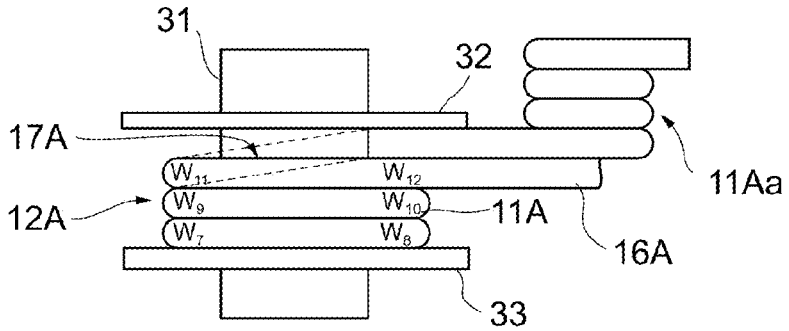

(4) As shown in FIG. 6B, at the outer circumference portion of the first wound layer of the winding wire portion 12A (see FIG. 4B), the second wound layer of the winding wire portion 12A is wound around in the order of the wire wound numbers $W_7 \rightarrow W_8 \rightarrow W_9 \rightarrow W_{10} \rightarrow W_{11} \rightarrow W_{12}$ also by alignment winding. At this stage, the winding wire portion 12A and the second lead portion 16A are formed.

Figure 6C:
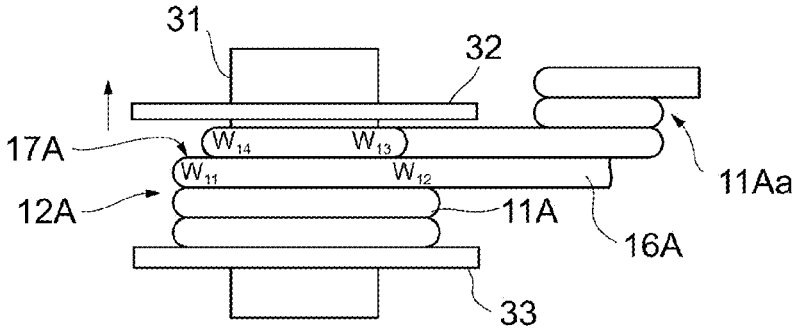

(5) As shown in FIG. 6C, a winding space is secured between the position of the wire wound numbers $W_{11}$, $W_{12}$ of the wire 11A and the first winding frame 32 by moving the first winding frame 32 upward in the drawing. Then, while feeding the storage wire 11Aa secured on the one end of the wire 11A and while closely contacting the fed storage wire 11Aa to the end surface 17A on one side in the axis direction of the winding wire portion 12A shown in FIG. 4B, the first winding of the spiral shaped wound portion 18A shown in FIG. 4B is formed in the order of the wire wound numbers $W_{13} \rightarrow W_{14}$ by winding the storage wire 11Aa in the spiral shape along the end surface 17A.

Figure 6D:
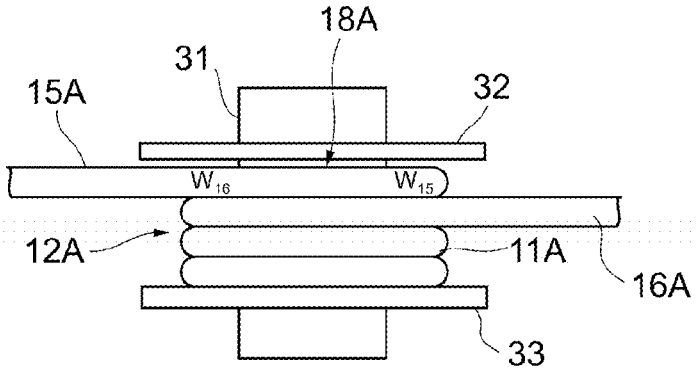

(6) As shown in FIG. 6D, while feeding the rest of the storage wire 11Aa and while closely attaching the fed storage wire 11Aa to the end surface 17A on one side in the axis direction of the winding wire portion 12A shown in FIG. 4B, the second winding of the spiral shaped wound portion 18A shown in FIG. 4B is formed in the order of the wire wound numbers $W_{15}$ to $W_{16}$ by winding the storage wire 11Aa in the spiral shape along the end surface 17A. At this stage, the spiral shaped wound portion 18A and the first lead portion 15A are formed. Thereafter, after the wound wire 11A is fused and dismounted from the winding shaft 32, the coil component 10A shown in FIG. 4B is formed. It should be noted that when the spiral shaped wound portion 18A is formed, the first winding frame 32 may be removed from the winding shaft 31. However, in this case, when the spiral shaped wound portion 18A is formed, an effect of the first winding frame 32 that holds and presses the wound wire 11A disappears. Therefore, there is a risk that the winding state of the spiral shaped wound portion 18A will be easily disturbed.

Other Embodiments of the Coil Component

Figure 7:
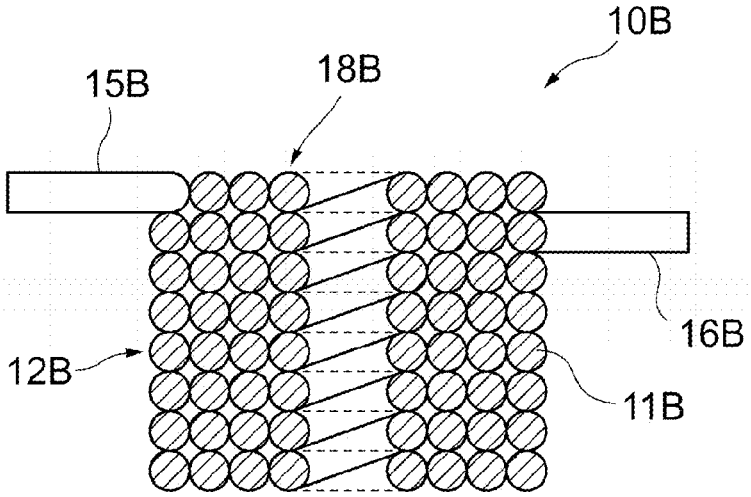
FIG. 7 is a cross-sectional schematic diagram showing a coil component according to a third embodiment of the present invention.

A coil component 10B according to a third embodiment shown in FIG. 7 is configured with a wire 11B and has an air-core winding wire portion 12B that is made to have a winding configuration of four layers & seven levels. The number of windings of a spiral shaped wound portion 18B is four. Both a first lead portion 15B and a second lead portion 16B are extended and extracted outward of the winding wire portion 12B on one side in the axis direction of the winding wire portion 12B (upper side in FIG. 7). This configuration is similar to those of the other embodiments mentioned above.

Figure 8:
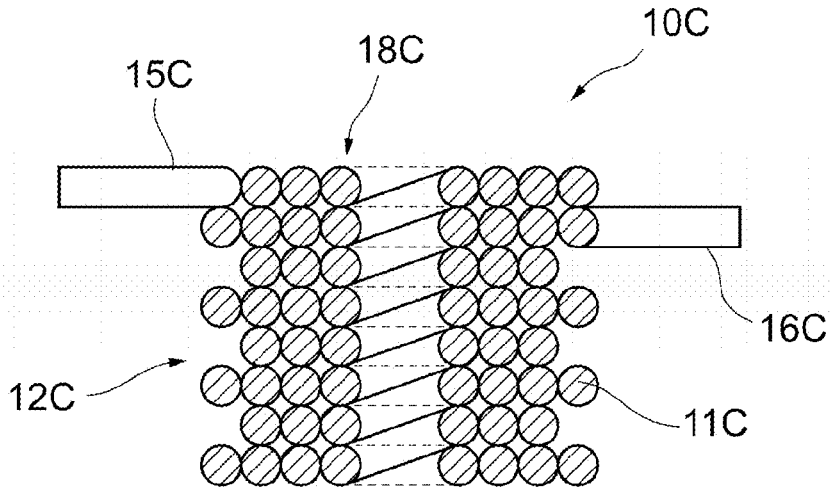
FIG. 8 is a cross-sectional schematic diagram showing a coil component according to a fourth embodiment of the present invention.

A coil component 10C according to a fourth embodiment shown in FIG. 8 is configured with a wire 11C and has an air-core winding wire portion 12C that is made to have a winding configuration of four layers & seven levels. The number of windings of a spiral shaped wound portion 18C is four. The above configuration of the coil component 10C is the same as the coil component 10B according to the third embodiment mentioned above. The difference is that the wound layer (fourth wound layer) at the outer circumference of the winding wire portion 12C is wound by a procedure which carries out the winding while providing a predetermined space between adjacent wires (space winding). This is preferred for a case in which the number of windings of the winding wire portion 12C is desired to be finely adjusted.

Configuration of Powder-Compacted Inductor

Next, a configuration of a powder-compacted inductor 50 according to one embodiment of the present invention will be explained below with reference to FIGS. 9 and 10. It should be noted in the following explanation that the coil component 10 according to the first embodiment mentioned above (see FIG. 2) is used. However, it is also possible to use coil components of other embodiment.

Figure 9:
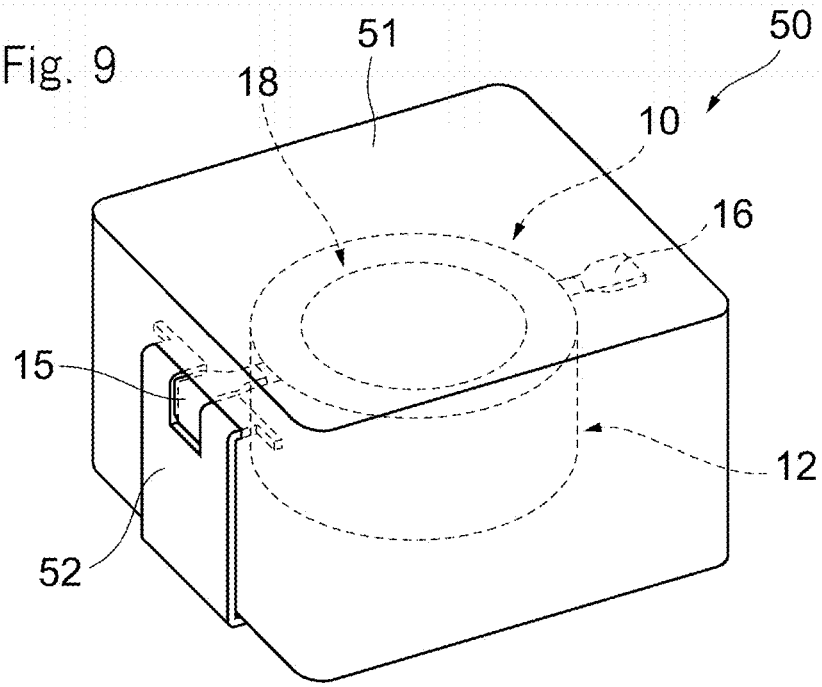
FIG. 9 is a perspective view showing an entire configuration of a powder-compacted inductor according to an embodiment of the present invention.
Figure 10:
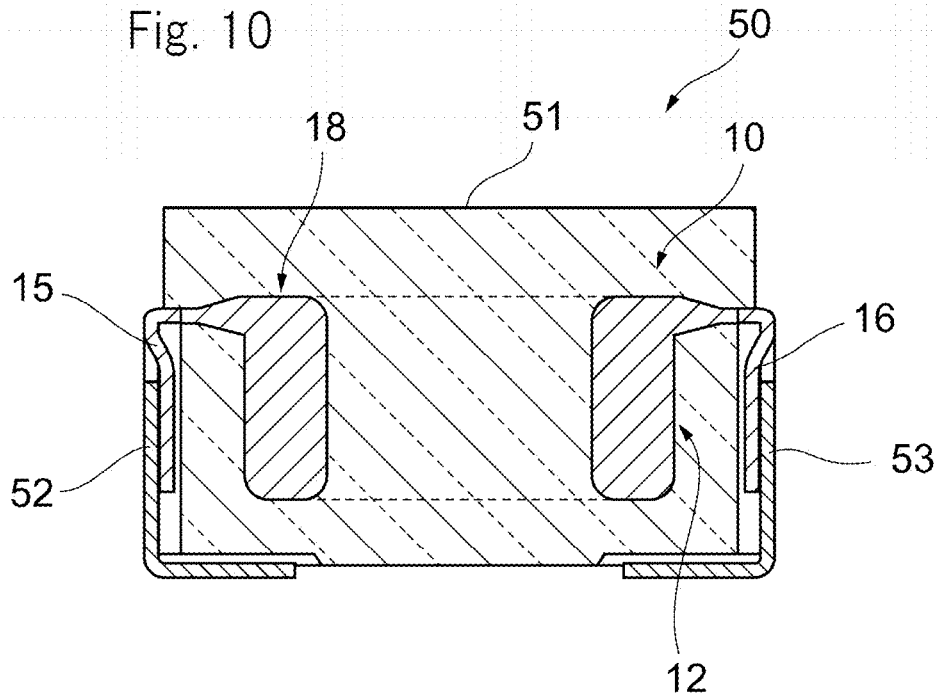
FIG. 10 is a cross-section view of a powder-compacted inductor according to an embodiment of the present invention.

The powder-compacted inductor 50 shown in FIGS. 9 and 10 generally includes a powder-compacted body 51 which is formed by compression-molding metal magnetic powder, the coil component 10 which is embedded inside the powder-compacted body 51, and a pair of terminals 52, 53 which are constituted by a plate member having electrical conductivity (in FIG. 9, only one terminal 52 is shown).

As the metal magnetic powder constituting the powder-compacted body 51, metal particles are used. The metal particles are insulation-coated by mixing metal series powder such as pure iron powder, an iron series alloy, and/or an amorphous metal with an insulation material such as a thermosetting resin, a thermoplastic resin, a lubricant, a cross-linking agent, and/or an inorganic substance.

A winding wire portion 12, a spiral shaped wound portion 18, and respective root portions of a first lead portion 15 and a second lead portion 16 of the coil component 10 are embedded inside the powder-compacted body 51. An edge portion of the first lead portion 15 and an edge portion of the second lead portion 16 are extended and extracted outward from side surface portions of the powder-compacted body 51.

Edge portions of the terminals 52, 53 are embedded inside the powder-compacted body 51. Other parts of the terminals 52, 53 arranged outside the powder-compacted body 51 are bent into an L-shape in their cross sections so as to go along the side surface portions and bottom surface portions of the powder-compacted body 51. Also, the terminal 52 and the terminal 53 are connected to the edge portion of the first lead portion 15 and the edge portion of the second lead portion 16, respectively.

Figure 3A:
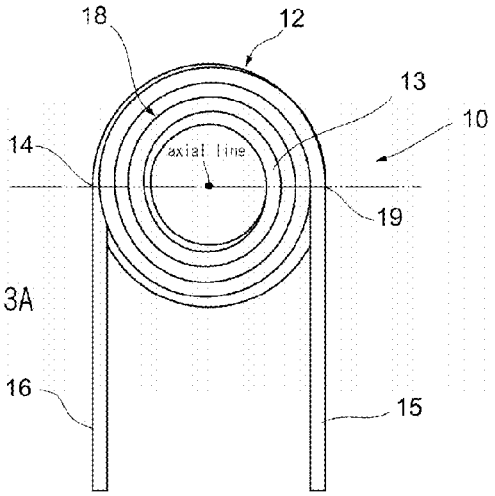
FIGS. 3A-3C are schematic views showing a coil component according to a first embodiment of the present invention.
Figure 3B:
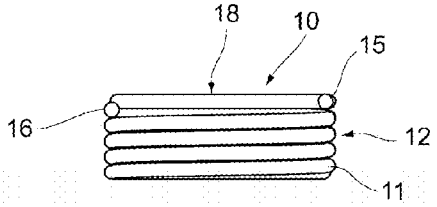
Figure 3C:
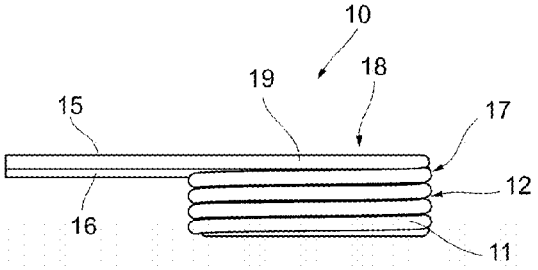

In considering the disposed positions of the terminals 52, 53 and the balance of the coil component 10 in a die when manufacturing the powder-compacted inductor 50 as mentioned next, as shown in FIG. 3A, it is preferred that the winding end point 19 of the spiral shaped wound portion 18 and the winding end point 14 at the outer circumference of the winding wire portion 12 are positioned so as to face each other in a state of sandwiching the axial line of the winding wire portion 12. In other words, they are positioned such that respective projection points of the winding end point 19 and the winding end point 14, and the axial line onto a plane surface perpendicular to the axial line are aligned on an approximately straight line (shown with a dashed line in FIG. 3A).

Manufacturing Method of Powder-Compacted Inductor

Figure 11A:
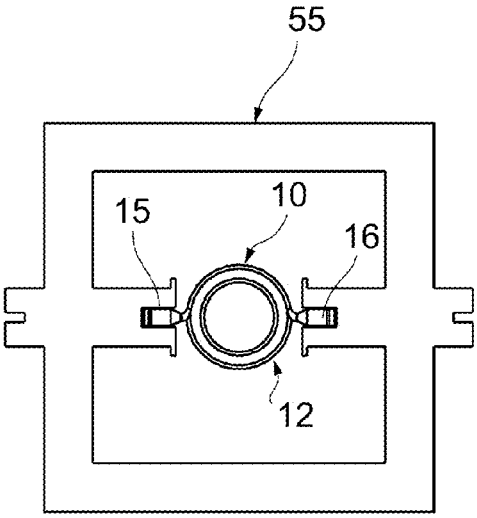
FIGS. 11A-11C are diagrams for explaining a manufacturing method for a powder-compacted inductor according to the present invention.
Figure 11B:
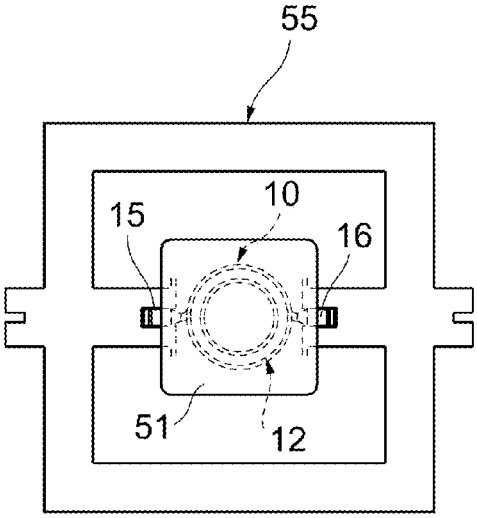
Figure 11C:
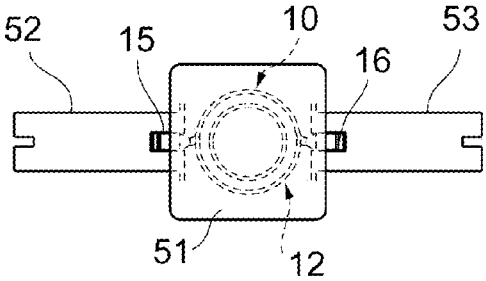

Next, a manufacturing method of the powder-compacted inductor 50 will be explained with reference to FIGS. 11A to 11C.

The coil component 10 and a terminal base material 55 which is formed in a frame shape are disposed in a die which is not shown. Then, after the first lead portion 15 and the second lead portion 16 are processed (see FIG. 11A), the powder-compacted body 51 is formed by supplying metal magnetic powder into the die (see FIG. 11B). Further, after undesired portions of the terminal base material 55 are cut away, the terminals 52, 53 are formed (see FIG. 11C). Then, the terminals 52, 53 are bent, thereby completing the powder-compacted inductor 50 shown in FIG. 9.

As described above, various embodiments of the present invention are explained. However, the present invention is not limited to the embodiments mentioned above. It is possible to variously depart from these embodiments.

For example, in the above embodiments, the wire constituting the coil components is made to be a single wire, however, it is also possible to constitute the coil component by using a plurality of parallel wires.

Also, in the coil components of the above embodiments, both the first lead portion and the second lead portion are extended and extracted outward of the winding wire portion on one side in the axis direction of the winding wire portion (in this case, the number of wound layers of the winding wire portion becomes an even number). However, the first lead portion can be extended and extracted outward of the winding wire portion on one side in the axis direction of the winding wire portion and the second lead portion can be extended and extracted outward of the winding wire portion on the other side in the axis direction of the winding wire portion respectively (in this case, the number of wound layers of the winding wire portion becomes an odd number).

Also, in the coil components of the above embodiments, the spiral shaped wound portion is wound in the spiral shape so as to cover the entire area of an end surface from the inner edge of the end surface over to the outer edge thereof and the first lead portion is extended and extracted outward from the outer edge of the end surface. However, a configuration may be employed in which the spiral shaped wound portion is wound in the spiral shape so as to cover a partial area on the inner edge side of the end surface and thereafter, the first lead portion reaches the outer edge by radially crossing an area on the outer edge side of the end surface and further, is extended and extracted outward.

Also, in the coil component according to the present invention, the number of wound layers of the winding wire portion and the number of winding levels are not limited by the aspects of the above embodiments. It is possible to set them variously according to the purpose of use or applications.

Also, in the coil components of the above embodiments, the outer edge shape of the winding wire portion and the shape of the air-core portion are both made to be circular. However, it is also possible for these shapes to be rectangular with rounded corners or elliptical.

Figure 12A:
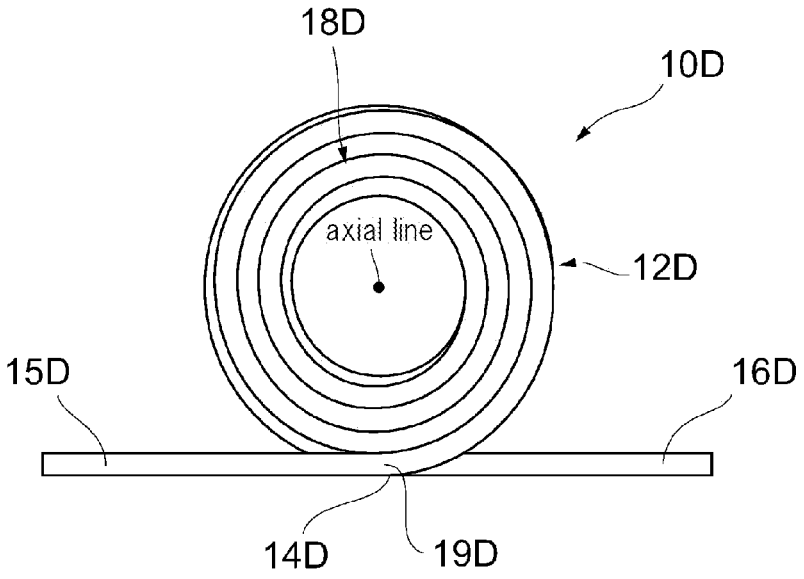
FIGS. 12A-12B are schematic views showing a coil component according to a fifth embodiment of the present invention.
Figure 12B:
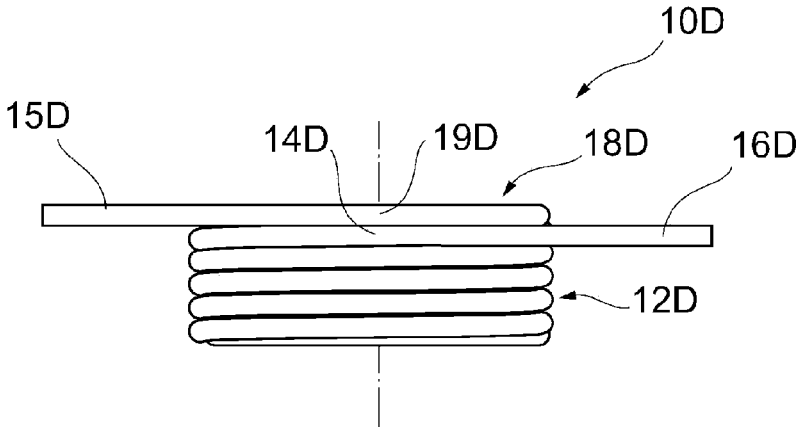

Also, in the coil components of the above embodiments, the winding end point of the spiral shaped wound portion and the winding end point at the outer circumference of the winding wire portion are constituted so as to be positioned to face each other in a state of sandwiching the winding wire portion. However, as a coil component 10D of a fifth embodiment shown in FIGS. 12A and 12B, the winding end point 19D of the spiral shaped wound portion 18D and the winding end point 14D at the outer circumference of the winding wire portion 12D may both be placed in the same position in the circumferential direction of the winding wire portion 12D (the position at which the winding end point 19D of the spiral shaped wound portion 18D and the winding end point 14D at the outer circumference of the winding wire portion 12D overlap each other when seen from the axis direction of the winding wire portion 12D (see FIG. 12A)). Then, the first lead portion 15D and the second lead portion 16D can be extended and extracted from this position in mutually different directions, in particular, to directions opposite to each other by 180°.

The pulling-out directions of the winding end point 19D of the spiral shaped wound portion 18D and the winding end point 14D at the outer circumference of the winding wire portion 12D can be designed arbitrarily in accordance with positions of terminals of a user of a related coil component and with particular design parameters.

Also, it is preferred that the coil component according to the present invention can be used for, besides a powder-compacted inductor, various electric parts and electronic apparatuses, such as, for example, optical pickups, various kinds of sensors or various kinds of antennas, and non-contact energy transfer apparatuses.

Having described preferred embodiments of the invention with reference to the accompanying drawings, it is to be understood that the invention is not limited by those precise embodiments and that various changes and modifications could be effected therein by one skilled in the art without departing from the spirit or scope of the invention as defined in the appended claims.

What is claimed is:

1. A powder-compacted inductor, comprising:

a powder-compacted body that is in a cubic shape having first and second side surfaces and a bottom surface continuously formed with the first and second side surfaces, the first and second side surfaces being opposite to each other;

a first terminal that is formed along the first side surface and that continuously extends to the bottom surface so as to be along the bottom surface;

a second terminal that is formed along the second side surface and that continuously extends to the bottom surface so as to be along the bottom surface; and a coil component that is embedded in the powder-compacted body, the coil component including a winding wire portion in which a wire having electrical conductivity is wound into a plurality of wound layers;

a spiral shaped wound portion in which the wire extends from a winding start point at an inner circumference of the winding wire portion and in which the wire is wound in a spiral shape from an inner edge of an end surface toward an outer edge of the end surface along the end surface while the wire is in contact with the end surface, the end surface being located at one side of the winding wire portion in an axis direction of the winding wire portion, the axis direction being perpendicular to the bottoms surface of the powder-compacted body;

a first lead extending outwardly from a winding first end point of the spiral shaped wound portion; and a second lead extending outwardly from a winding second end point at an outer circumference of the winding wire portion, wherein the first and second leads are both positioned at the one side of the winding portion in the axis direction, first and second lead roots of the first and second leads are embedded in the powder-compacted body, respectively, first and second lead ends of the first and second leads extend outwardly from the first and second side surfaces of the powder-compacted body, respectively, and the first and second lead ends are connected to first and second terminal ends of the first and second terminals outside of the first and second side surfaces of the powder-compacted body, respectively.

2. The powder-compacted inductor, according to claim 1, wherein the winding start point at the inner circumference and the winding second end point at the outer circumference of the winding wire portion are both positioned at the one side of the winding wire portion, and the first and second leads both extend outwardly at the one side of the winding wire portion.

3. The powder-compacted inductor, according to claim 1, wherein the powder-compacted body includes compression-molded metal magnetic powder.

4. The powder-compacted inductor, according to claim 1, wherein the winding wire portion is an alignment winding portion and the plurality of wound layers include an inner wound layer and a second layer, one end of the wire is wound such that the adjacent wires closely contact each other from one end of an axial line to the other end of the axial line to configure the inner wound layer, the second wound layer is formed around an outer circumference portion of the inner wound layer so that the adjacent wires closely contact each other from the other end of the axial line to the one end of the axial line.

5. The powder-compacted inductor, according to claim 1, wherein the number of level of the spiral shaped wound portion is one.

6. The powder-compacted inductor, according to claim 1, wherein the first and second leads are in different but close levels of the plurality of wound layers.

7. The powder-compacted inductor, according to claim 1, wherein the outermost adjacent windings of the plurality of wound layers are axially spaced apart from each other.

8. The powder-compacted inductor, according to claim 1, wherein the first and second terminal ends of the first and second terminals are embedded in the powder-compacted body.

* * * * *